US008647242B2

(12) United States Patent
Schlicher

(10) Patent No.: US 8,647,242 B2
(45) Date of Patent: Feb. 11, 2014

(54) STRIKING TRAINING APPARATUS

(76) Inventor: John C. Schlicher, Hampstead, NH (US)

( * ) Notice: Subject to any disclaimer, the term of this patent is extended or adjusted under 35 U.S.C. 154(b) by 182 days.

(21) Appl. No.: 13/298,943

(22) Filed: Nov. 17, 2011

(65) Prior Publication Data

US 2012/0214648 A1 Aug. 23, 2012

Related U.S. Application Data

(60) Provisional application No. 61/463,632, filed on Feb. 22, 2011.

(51) Int. Cl.
*A63B 69/22* (2006.01)

(52) U.S. Cl.
USPC ..... 482/87; 482/83; 482/84; 482/90

(58) Field of Classification Search
USPC ..... 482/83–86, 87, 89, 90, 88; 272/76, 77, 272/78; 434/256, 258, 259; 473/441, 442, 473/443
See application file for complete search history.

(56) References Cited

U.S. PATENT DOCUMENTS

| | | | | | |
|---|---|---|---|---|---|
| 396,938 | A | | 1/1889 | Kemmler | |
| 615,700 | A | | 12/1898 | Hess | |
| 1,205,684 | A | * | 11/1916 | Tothill | 182/97 |
| 3,114,549 | A | * | 12/1963 | Hooker | 473/443 |
| 4,093,212 | A | | 6/1978 | Jacques | |
| 4,309,029 | A | | 1/1982 | Tomko | |
| 4,635,929 | A | | 1/1987 | Shustack | |
| 4,702,472 | A | | 10/1987 | Anquetil | |
| 4,749,184 | A | | 6/1988 | Tobin | |
| 4,836,533 | A | | 6/1989 | Dong | |
| 4,932,652 | A | * | 6/1990 | Beall, III | 482/83 |
| 5,046,724 | A | * | 9/1991 | Sotomayer | 482/90 |
| 5,183,451 | A | * | 2/1993 | Hautamaki | 482/86 |
| 5,277,679 | A | | 1/1994 | Wells | |
| 5,458,552 | A | * | 10/1995 | Mara | 482/90 |
| D370,507 | S | | 6/1996 | Kha | |
| 5,800,319 | A | * | 9/1998 | Choate | 482/83 |
| 5,897,465 | A | * | 4/1999 | Hautamaki | 482/83 |
| 5,899,835 | A | * | 5/1999 | Puranda | 482/90 |
| 6,808,477 | B2 | * | 10/2004 | Tudor | 482/83 |
| 7,044,895 | B1 | | 5/2006 | Iglehart | |
| 7,479,094 | B1 | * | 1/2009 | Alexander | 482/83 |
| 7,654,941 | B2 | | 2/2010 | Lacher | |
| 7,914,423 | B1 | | 3/2011 | Cogan | |
| 2004/0220021 | A1 | | 11/2004 | Bryant | |
| 2008/0020910 | A1 | * | 1/2008 | Preciado | 482/83 |
| 2008/0032872 | A1 | | 2/2008 | Nappier | |
| 2008/0076636 | A1 | | 3/2008 | Smith | |
| 2011/0059827 | A1 | | 3/2011 | Fazio | |

OTHER PUBLICATIONS http://www.merriam-webster.com/dictionary/track (c) 2013 Merriam-Webster, Inc.*
"Focusmaster G-1000 Single Station" www.centurymartialarts.com/Targets_and_Shields/Focusmaster/FocusMaster_G-1000_Single_Station_Training_System.aspx.

* cited by examiner

*Primary Examiner* — Loan Thanh
*Assistant Examiner* — Nyca T Nguyen
(74) *Attorney, Agent, or Firm* — Lambert & Associates; Gary E. Lambert; David J. Connaughton, Jr.

(57) ABSTRACT

A striking apparatus is provided. The striking apparatus may be mounted to a wall and at least partially supported by a movement device in contact with a floor. The striking apparatus has a plurality of pads which may receive strikes from a user. Spring assemblies are utilized to absorb force applied by the user.

20 Claims, 7 Drawing Sheets

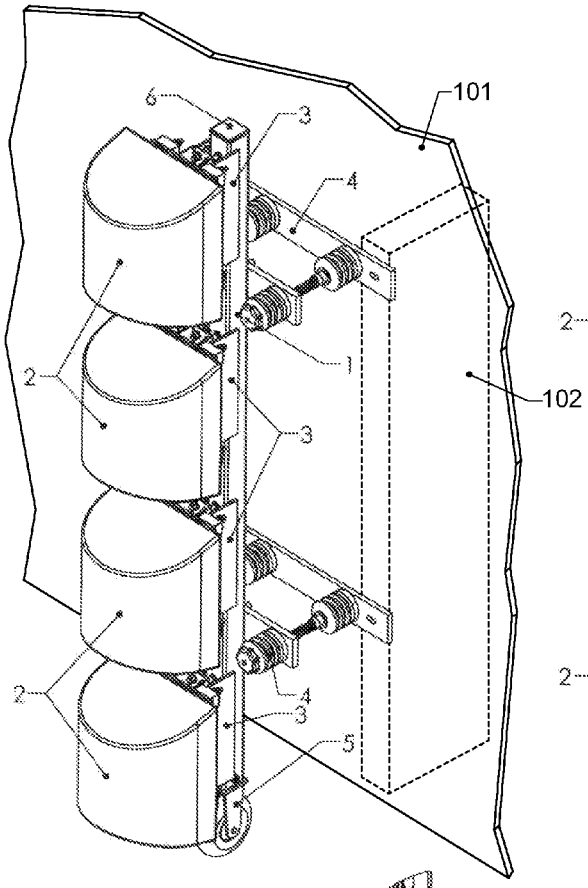
Fig. 1.0
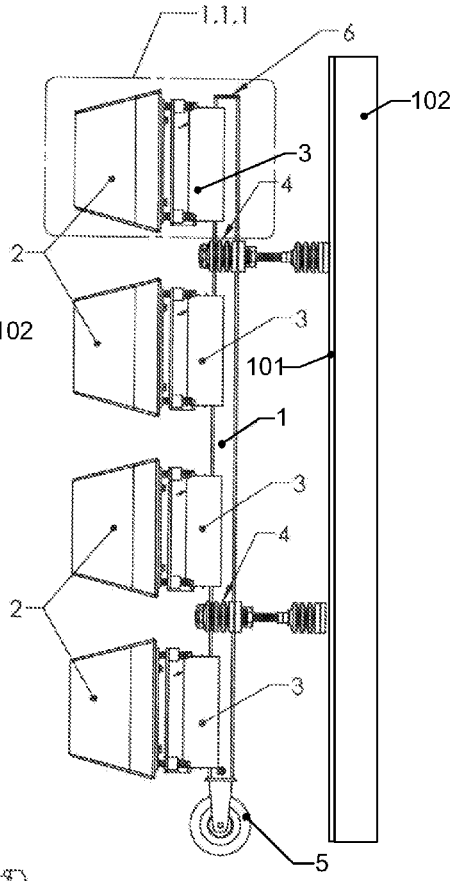
Fig. 1.1
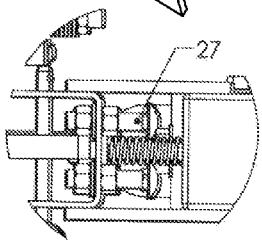
FIG 1.2.1
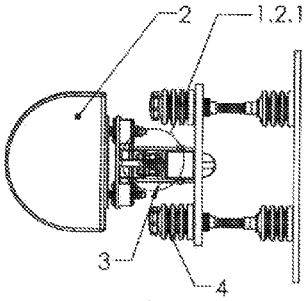
Fig. 1.2
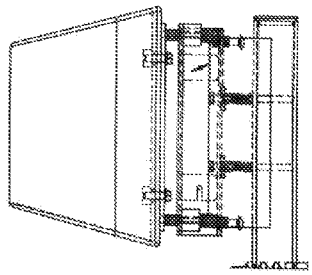
Fig. 1.1.1

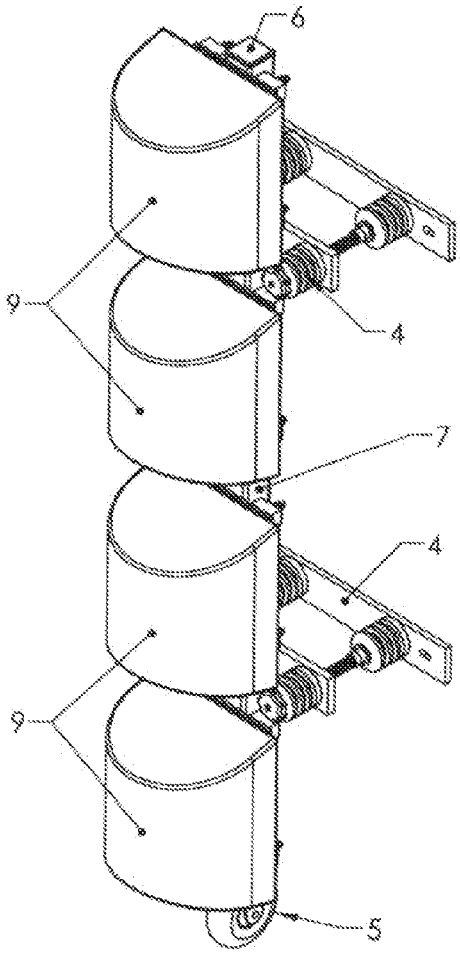
Fig. 2.0
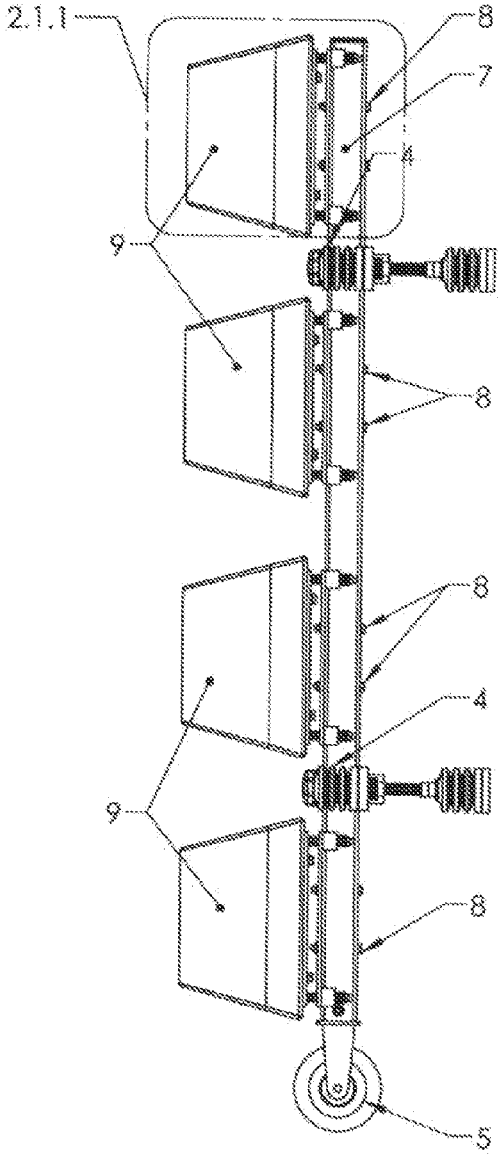
Fig. 2.1
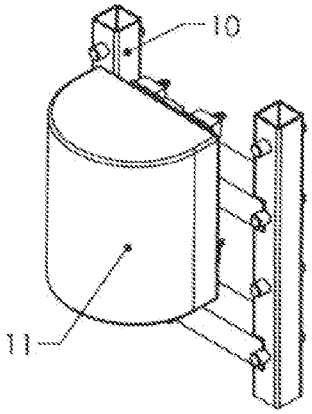
Fig. 3.0
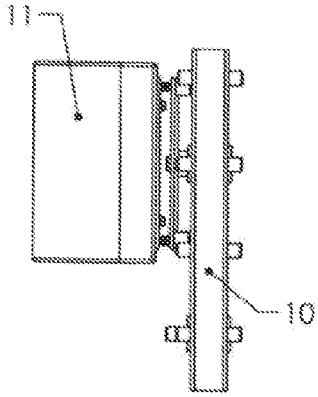
Fig. 3.1
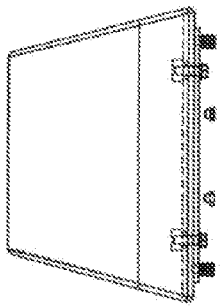
Fig. 2.1.1

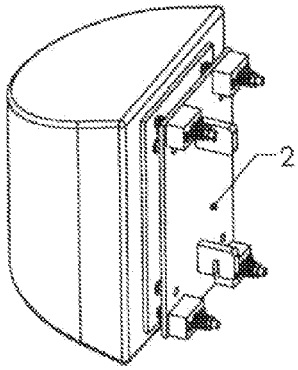
Fig. 4.0
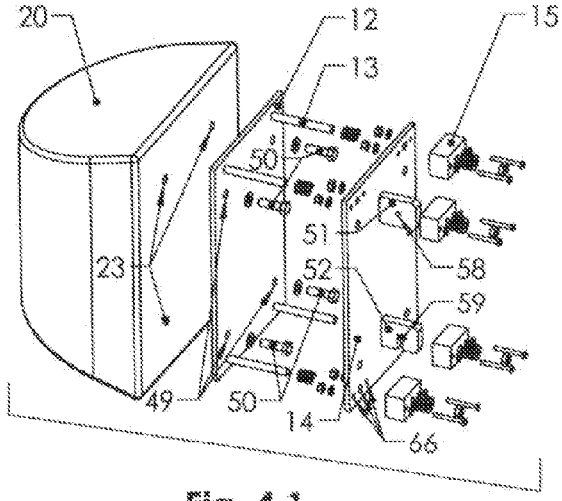
Fig. 4.1
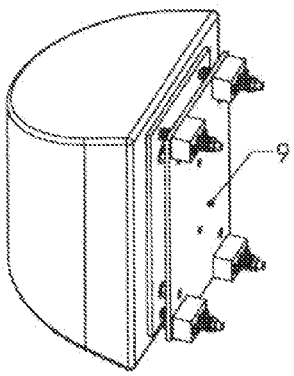
Fig. 4.2
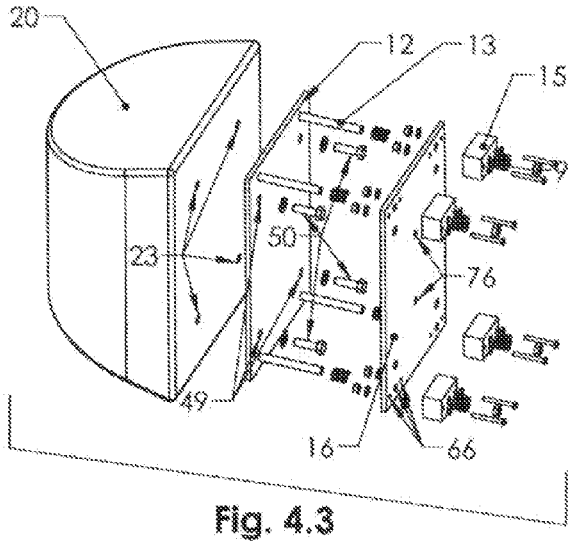
Fig. 4.3
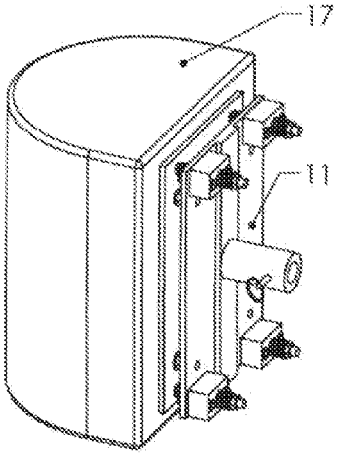
Fig. 4.4
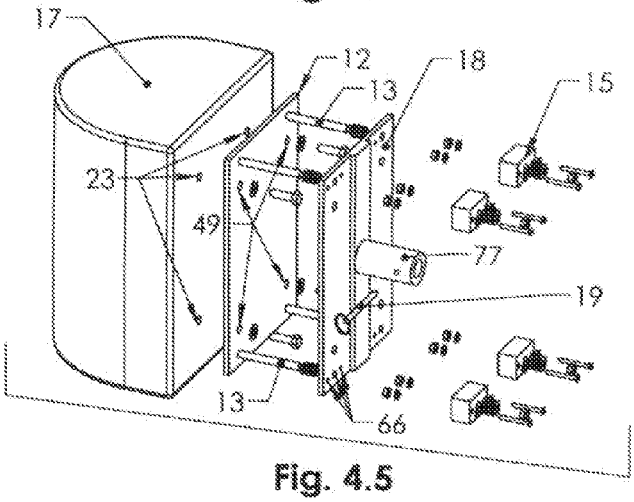
Fig. 4.5

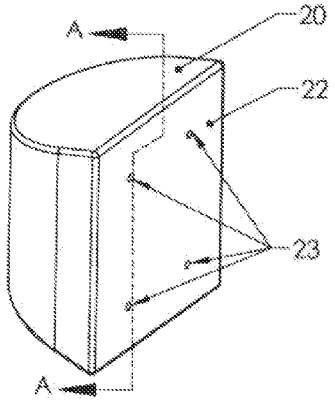
Fig. 5.0
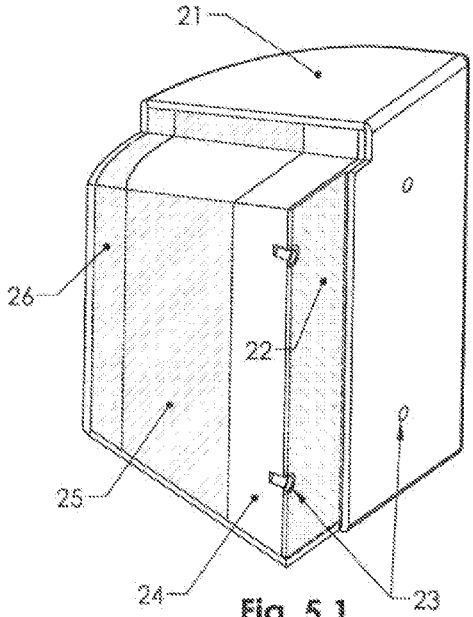
Fig. 5.1
Section A-A
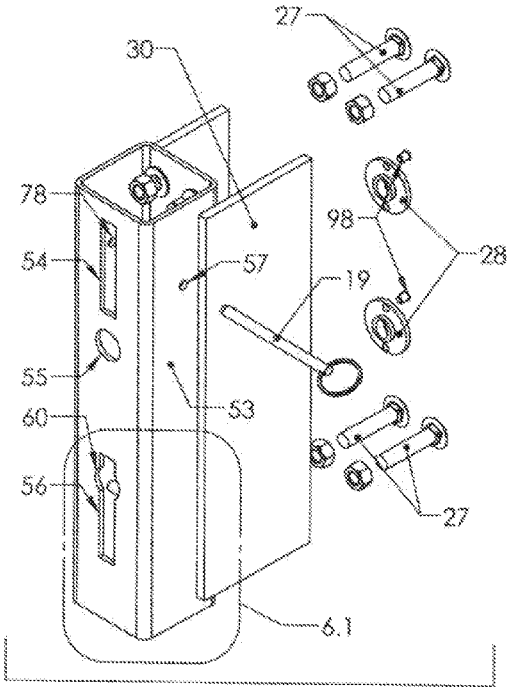
Fig. 6.0
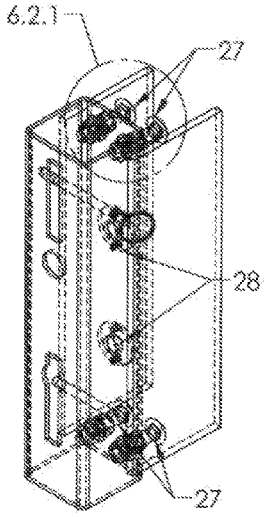
Fig. 6.2
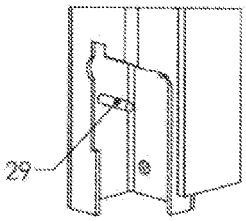
Fig. 6.1
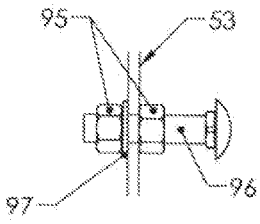
Fig. 6.2.1

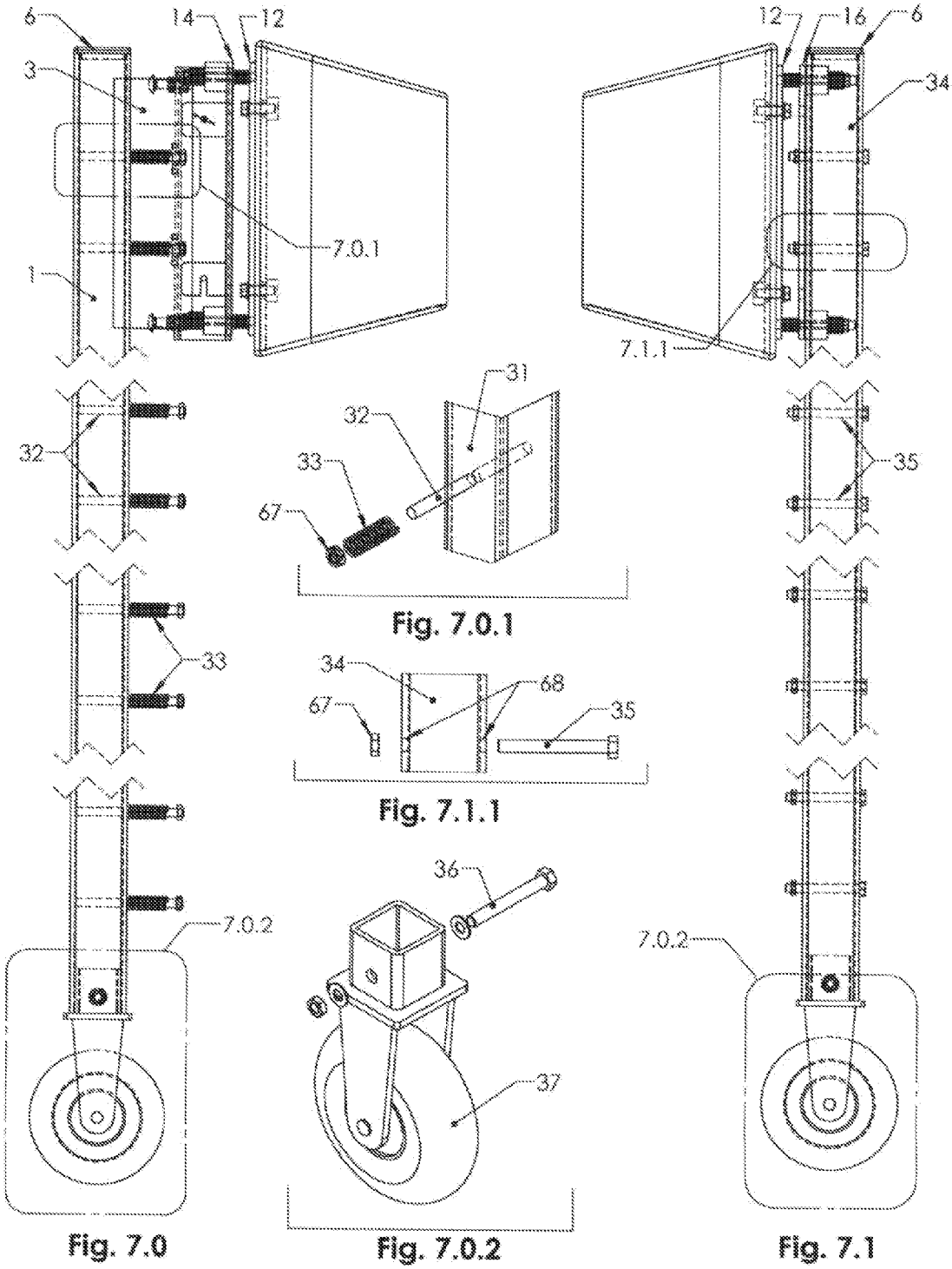
Fig. 7.0
Fig. 7.0.1
Fig. 7.1.1
Fig. 7.0.2
Fig. 7.1

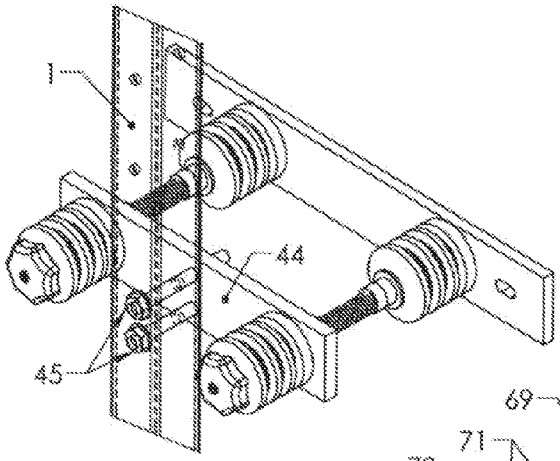
Fig. 8.0
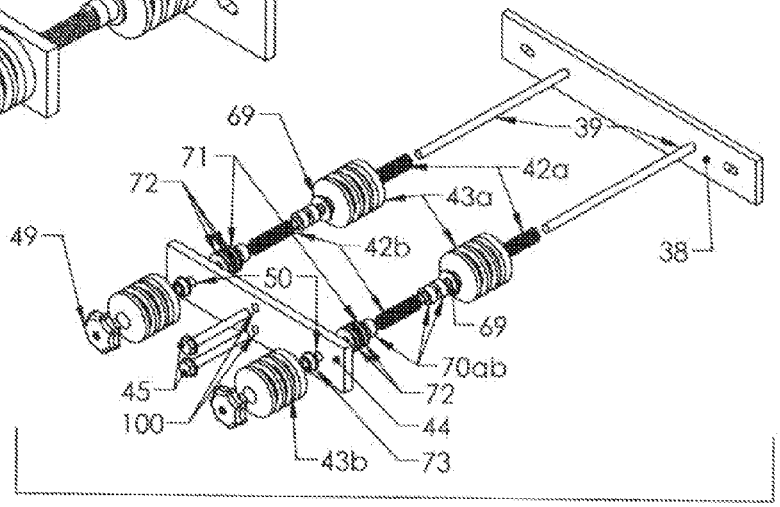
Fig. 8.1
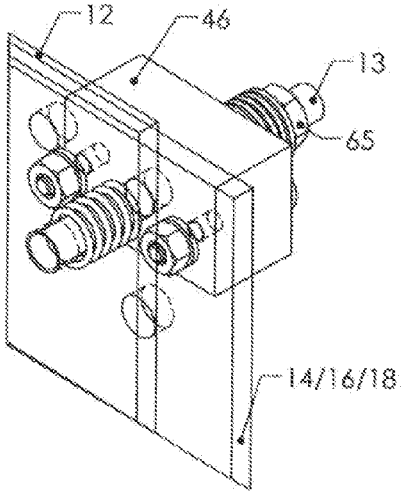
Fig. 9.0
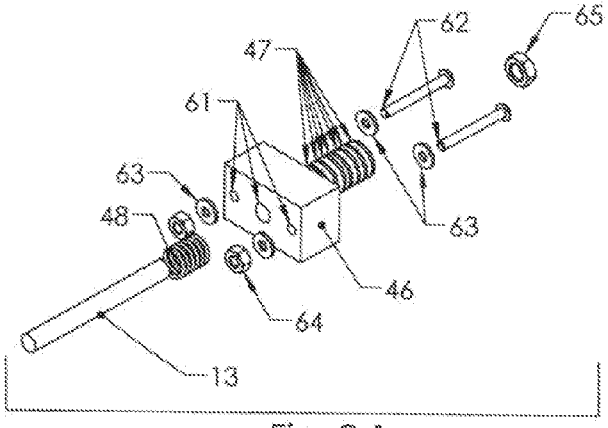
Fig. 9.1

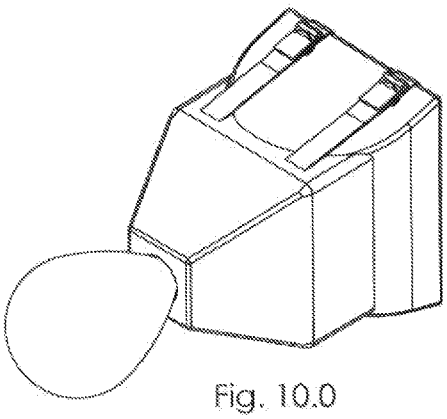
Fig. 10.0
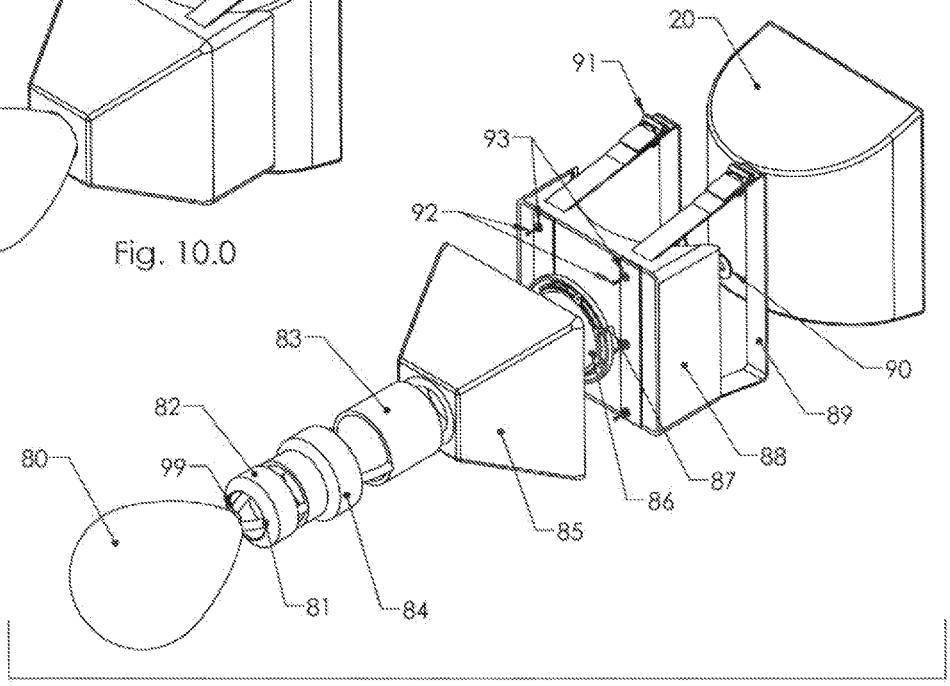
Fig. 10.1
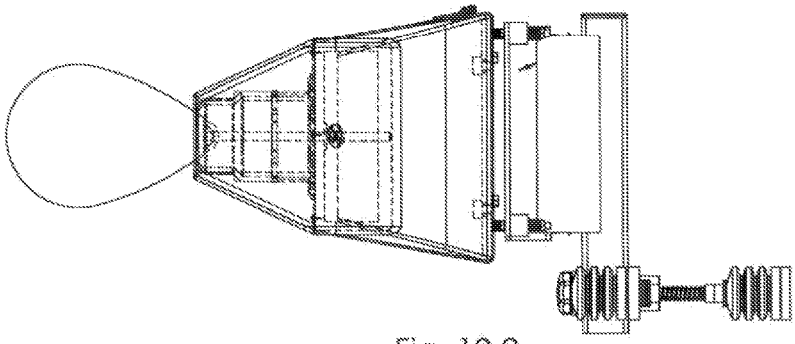
Fig. 10.2

STRIKING TRAINING APPARATUS

BACKGROUND

This application relates to striking devices used to train individuals for fighting in sporting events and in combat situations, as well as for individuals who wish to use these training methods for personal fitness, weight loss and recreational purposes.

In particular, it relates to training devices for the practice of hand, foot, elbow and knee strikes for improvement of skills in the area of Martial Arts, Mixed Martial Arts, Boxing, Kick Boxing, Law Enforcement, Military, or any other field where a total body workout is desired while practicing fighting skills.

With the ever growing interest in martial arts by both civilians and the military (particularly mixed martial arts), a sturdy device that will allow a user to practice and improve skills without causing harm to others would be beneficial.

In the prior art, it is often necessary to have a partner hold a striking device; those wishing to improve their skills when they are alone are limited in their choices. Injuries are also a common problem when holding striking devices for others.

A key part of true combat fighting is the use of upper cut strikes, elbow strikes and knee strikes. There is no prior art that we could locate that is designed to allow a user to practice elbow and knee strikes, particularly in combination with hand strikes and kicks, without multiple equipment adjustments.

The use of various types of padded striking devices which could be utilized to improve hitting and kicking skills using some type of spring mechanism is well known in the prior art. As far back as U.S. Pat. No. 615,700 issued to Hess on Dec. 13, 1898 shows a punching bag with a spring mechanism. Today, large heavy punching bags, which are usually mounted by a single harness from an overhead support, largely represent the state of the art in providing striking practice for developing kicking and punching skills. An important deficiency experienced with this art is they are only useful in developing punching skills of straight punches, or "hook" punches, (a close punch delivered from the side). Lacking in this art is the ability to develop an uppercut punch (a rapidly rising blow delivered with the arm bent up), or strikes with the knees or elbows from above or below.

In U.S. Pat. No. 4,702,472 issued to Anquetil on Oct. 27, 1987, a training dummy for combat sports is described. When reviewed closely, several deficiencies are found.

Most prior art also fails to provide the so-called "bounce-back after the strike is delivered. This is a feeling that occurs in an actual event when an individual lands a strike on another person. In most prior art, a strike lands on a dull and unresponsive surface which 1) does not accurately simulate what occurs in an actual fighting situation and 2) does not provide an 'incentive' for continued strikes.

U.S. Patent Application No. US 2004/0220021 A1, Nov. 4, 2004 to Bryant for a Martial Arts Practice Apparatus which indicates a wall mounted device with a singular striking pad mounted on wood with springs. It includes an electrical circuit that blinks. This device does not appear to address the issue of durability, particularly when utilized for military, law enforcement, or high level martial arts. In particular, the electrical circuitry may not be practical when the unit is experiencing heavy usage. The forces involved would eventually loosen wires or damage the lights which could render this concept useless. Application 0220021 also does not appear to be practical for the practice of knee, elbow and upper cut strikes.

U.S. Pat. No. 4,309,029 describes a device ". . . comprising a base and at least two arc supports of differing heights". The inventor goes on to describe the invention as one that can be used by "students . . . of a variety of size and strengths". It appears that the inventor is using the terms 'size' and 'strength' synonymously. The invention in question makes a provision for adjusting the tension of the springs, which would allow users of different strengths to use the machine (note that this would be AFTER the machine was adjusted), however, there are only two pads, and the heights of the pads are not variable. Therefore, it would be impractical, if not impossible, for a 5-year-old student to use the device and for a 25-year-old to use it without adjustment. Our device allows for use by users of all sizes without any adjustments whatsoever. Also, because the pads of U.S. Pat. No. 4,309,029 are set at a single height, it only allows the practice of strikes at those two levels, not at a variety of levels as our device allows. The mounting of one pad behind the other in U.S. Pat. No. 4,309,029 leads us to believe that it is, at best, impractical, and at worst, dangerous, to perform kicking strikes on the back pad. Therefore, this limits kicking strikes to only one pad that must be adjusted multiple times.

In U.S. Pat. No. 4,702,472 issued to Anquetil on Oct. 27, 1987, a training dummy for combat sports is described. When reviewed closely, several deficiencies are found. The side to side movement of U.S. Pat. No. 4,702,472 does not necessarily accurately simulate an opponent. When fighting an actual opponent their tactical movements would be based on real attacks and counter attacks, and not random, side to side movements based on chance. In addition, the 5 degree forward angle starting position of U.S. Pat. No. 4,702,472 results in an unrealistic starting point for the athlete when striking the device. Fighters of all different styles would be hard pressed to find an opponent leaning 5 degrees forward with their face or body. In one embodiment, FIG. 2, of U.S. Pat. No. 4,702,472 it shows arms and legs but they cannot engage the athlete with realistic skills, and appear very suspect to durability.

The numerous and varied assembly groups that are used in U.S. Pat. No. 4,702,472 require a plethora of moving parts. These parts may require periodic maintenance and replacement, adding an additional downtime and expense. Further, there are numerous assembly groups and components within the device that appear to be working against one another to create the intended movements. For instance, the spring used to return the dummy to "it's most inclined position forward" (along the vertical axis), is fine for that purpose, however, stresses will be created on the mounting point of the spring when the bearing shaft allows the dummy to move along the horizontal axis. Another area of concern is the use of a tubular sheath over the vertical mounting element. This type of design may tend to bind up under moderate or heavy use. In summary, when strikes and kicks are delivered with great force, and/or in a continuous fashion over a long period of time, the durability of U.S. Pat. No. 4,702,472 is an issue.

Another shortcoming of U.S. Pat. No. 4,702,472 is that using a sliding head frame to perform upper cuts and requiring a hydraulic or screw jack to adjust the devices height requires multiple adjustments that stop, or slow down the flow of a workout. Our devices strategically placed, slanted pad surfaces require no adjustment, allowing an athlete, from an average 5 year old, up to a skilled MMA fighter, to work out on the device using the same strikes, kicks, elbows, knees or any combination of these without any adjustments or stoppage in the flow of the workout.

In U.S. Pat. No. 4,702,472, the inventor describes a "fixing element 6 of the support can be attached to a wall of training building or propped up between its ceiling and floor". In the description, the sturdiness of the method of attachment to floor, ceiling or wall is so vague it begs for further description or proof for practical, real world usage. Further, U.S. Pat. No. 4,702,472 lacks the sturdiness and practicality of our attachment to the wall.

Most prior art also fails to provide the proper "bounce-back" after the strike is delivered. This is a feeling that occurs in an actual event when an individual lands a strike on another person. In most prior art, a strike lands on a dull and unresponsive surface which 1) does not accurately simulate what occurs in an actual situation and 2) does not provide an 'incentive' for continued strikes.

SUMMARY

All of the devices above are potential solutions for the intended purpose. However, new improvements are constantly being added to the store of prior art. The mere fact that so many patents have issued on such devices is indicative of consumer interest and demand. Any improvement or innovation which results in a better user experience, can be used in multiple disciplines, allows for a wider variety of practice strikes and provides a more efficient or economical construction which would fulfill a need in this area.

In summary, the advantages that this device provides include, but are not limited to: 1) designed for three styles of fighting, combat, competitive and recreational, 2) safety and reduction of potential injuries because you strike the device and not an opponent, and it eliminates the need for a partner to hold pads 3) saving floor space because it has a smaller 'footprint' than much of the prior art 4) the spring mechanisms in combination with the caster assembly provides better user experience than is available in the prior art 5) the caster (or similar) assembly eliminates the need to anchor the device to the floor 6) the caster (or similar) assembly allows the device to move smoothly which provides an added incentive to the athlete to have a longer and more vigorous workout 7) it is specifically designed to allow for the practice of hand, foot, knee and elbow strikes in one device, without the need of adjustments which is a feature that is limited or nonexistent in prior art. 8) It can be used by individuals of any size and ability, at the same time, without adjustments.

In one aspect, the present invention is designed to provide users at all levels and abilities an automatic incentive to have longer and more vigorous workouts through the use of the multiple spring mechanisms in combination with the caster (or similar) assembly which creates a moveable center post. When struck by a user at a low level of force, the spring mechanism on the striking pads will move and return to its original position almost immediately, and provide an audible cue to the user. When struck with a higher level of force, not only does the striking pad move, but the spring mechanism on the wall mount assembly absorbs some of the force, while at the same time the entire device is allowed to move smoothly along the horizontal plane because it is mounted on a caster or similar assembly, and is not secured to the floor. This provides a strong incentive for an athlete to keep working to have the device move towards the wall.

The prior art lacks the spring loaded assemblies that work in conjunction with, in our embodiments, a balloon caster (any other suitable device could be used) that is mounted to the bottom of the main center post. This provides the desired feel when struck or kicked with heavy force from a powerful and experienced athlete. Two other benefits of the balloon caster are that it allows the center post to smoothly glide horizontally, and it helps to provide the necessary response from our embodiment when struck with the downward force of an elbow or similar strike. These unique characteristics are key to providing an incentive for the athlete to have longer and more vigorous workouts. Our two large spring assemblies hold a center post which is placed on a balloon caster, wheel, moveable track, or any other similar suitable device, to help support the unit and ensure its smooth backward movement and instant replacement to its original position of readiness when engaged. This configuration also provides a significant reduction in the noise and vibration caused by the use of our device.

It is an object of this invention to provide an audible and tactile cue to the operator to increase the incentive for hitting.

It is also an object of this invention that individuals of all heights, ages and skill levels can practice striking techniques on the same embodiment without having to adjust or change it in any way. This also allows an instructor to have students of different sizes and abilities use the equipment all at the same time.

It is another object of this invention that the various heights and angles of the striking pads allow a user to practice a wide variety of techniques including from lower body "knee strikes" and "shin kicks" to upper body punches and strikes. The option of practicing upper cut strikes and knee and elbow strikes from above and below are also incorporated in the embodiment. A unique feature of the embodiment is that all of these techniques can be practiced without any adjustments to the embodiment.

It is yet a further object of this invention that the apparatus can be used for military, sporting and civilian applications.

It is still a further object of this invention that it be used to improve the aim, force and technique of a wide variety of strikes and kicks with the hands, feet, elbows and knees without having to adjust the machine in any way. One minor 'on the fly' placement of a head assembly allows the user to practice multiple styles of head level kicks.

It is yet another object of this invention to maximize efficient space utilization and provide ease of installation. The device has a smaller 'footprint' than free standing devices or a suspended heavy bag. It is wall mounted to increase stability and durability and can be mounted sixteen inches on center to match standard studs. The mounting can also be adapted to other types of wall construction. The wall is protected from damage and excessive noise by the unique shock absorbing properties of the wall mount assembly and caster assembly.

It is also another object of this invention that users of the unit can practice alone without need for a partner to hold a striking pad.

It is another object of this invention that the apparatus helps to effectively train a student while minimizing the risk of injury to them or others.

BRIEF DESCRIPTION OF THE DRAWINGS

FIG. 1.0 shows a dynamic view of one embodiment of the striking apparatus.

FIG. 1.1 shows a side view of one embodiment of the striking apparatus.

FIG. 1.2 shows a top view of one embodiment of the striking apparatus.

FIG. 1.2.1 shows a top view of the connector channel assembly attached to the main post.

FIG. 1.1.1 shows a dynamic view of an embodiment of the striking apparatus.

FIG. 2.0 shows a side view of an embodiment of the striking apparatus.

FIG. 2.1 shows a side view of an embodiment of the striking apparatus.

FIG. 2.1.1 shows a side view of the striking pad assembly in an embodiment of the striking apparatus.

FIG. 3.0 shows a dynamic view of the striking pad of an embodiment of the striking apparatus.

FIG. 3.1 shows a side view of the striking pad of an embodiment of the striking apparatus.

FIG. 4.0 shows a dynamic view of an embodiment of the striking pad assembly.

FIG. 4.1 shows an exploded view of an embodiment of the striking pad assembly.

FIG. 4.2 shows a dynamic view of an embodiment of the striking pad assembly.

FIG. 4.3 shows an exploded view of an embodiment of the striking pad assembly.

FIG. 4.4 shows a dynamic view of an embodiment of the striking pad assembly.

FIG. 4.5 shows an exploded view of an embodiment of the striking pad assembly.

FIG. 5.0 shows a cut down view of an embodiment of the striking pad assembly.

FIG. 5.1 is a cut down view of an embodiment of the striking pad assembly.

FIG. 6.0 is a dynamic view of an embodiment of the connector channel assembly.

FIG. 6.1 is a detail view of an embodiment of the bottom retainer pin.

FIG. 6.2 is a cut away view of an embodiment of the connector channel assembly.

FIG. 6.2.1 is a detail view of an embodiment of the carriage bolt assembly.

FIG. 7.0 is a side view of an embodiment of the striking pad assembly attached to the main post.

FIG. 7.0.1 is a detail view of an embodiment of the mounting rods.

FIG. 7.0.2 is a drawing of an embodiment of the caster assembly.

FIG. 7.1 is a side view of an embodiment of the striking pad attached to the main post assembly.

FIG. 7.1.1 is a detail view of an embodiment of the mounting rods.

FIG. 8.0 is a dynamic view of an embodiment of the wall mount assembly.

FIG. 8.1 is an exploded view of an embodiment of the wall mount assembly.

FIG. 9.0 is a dynamic view of an embodiment of the bushing assembly.

FIG. 9.1 is an exploded view of an embodiment of the bushing assembly.

FIG. 10.0 is a dynamic view of an embodiment of the speed bag attachment assembly.

FIG. 10.1 is an exploded view of an embodiment of the speed bag attachment assembly.

FIG. 10.2 is a side view of an embodiment of the speed bag attachment assembly attached to a striking pad.

DETAILED DESCRIPTION

In summary, the advantages that this device provides include, but are not limited to: 1) designed for three styles of fighting: combat, competitive and recreational; 2) enhanced safety and reduction of potential injuries because a user strikes the device and not an opponent, and it eliminates the need for a partner to hold pads; 3) saved floor space because it has a smaller 'footprint' than much of the prior art 4) the spring mechanisms in combination with the caster assembly providing better user experience than is available in the prior art; 5) the caster (or similar) assembly eliminates the need to anchor the device to the floor; 6) the caster (or similar) assembly allows the device to move smoothly which provides an added incentive to the athlete to have a longer and more vigorous workout; 7) it is specifically designed to allow for the practice of hand, foot, knee and elbow strikes in one device, without the need of adjustments which is a feature that is limited or nonexistent in prior art; and 8) it can be used by individuals of any size and ability, at the same time, without adjustments.

Referring to FIG. 1.0 the first embodiment consists of four general elements. The first element is a striking pad assembly 2 which is attached to a connector channel assembly 3 which is attached to a main post 1 which is attached to a wall mount 4. The wall mount 4 is then attached securely to a wall. Each of the elements is described in detail below.

Referring to FIG. 1.0 the first embodiment consists of four general elements. The first element is a striking pad assembly 2 which is attached to a connector channel assembly 3 which is attached to a main post 1 which is attached to a wall mount 4. The wall mount 4 is then attached securely to a wall 101. In one embodiment, the wall mount 4 may be attached to the wall 101 through the use of a stud 102 of a framing of the wall 101. Each of the elements is described in detail below. In one embodiment, the striking pad assembly 2 comprises a striking pad 20 and accessories of a spring assembly shown in FIGS. 4.1, 4.3 and 4.5. FIGS. 3.0 and 3.1 show striking pad assembly 11, an alternative embodiment of striking pad assembly 2 and 9, attached to post 10.

In one embodiment, the striking pad 20 (FIG. 4.0) is designed to provide three striking surfaces that take full advantage of a built in spring mechanism to provide the proper tactile and audible feedback to the user. The surfaces of the striking pad provide user friendly contact points for strikes with the hands, elbows, knees and feet. In one embodiment, the striking pad 20 (see FIG. 5) may be 15 inches in length from top to bottom in the rear and tapering to 9 inches in the front. This shape provides sufficient surface area for a user to strike, however one of ordinary skill in the art will understand that other dimensions providing an adequate strike surface area may also be provided. To provide the surface area shown in FIG. 5, the top and the bottom of the pads are evenly tapered by 3 inches from front to rear. This creates a slanted surface at the top and bottom of the pads for elbow (top) and knee (bottom) strikes to be practiced. The front of the pad then becomes 9 inches in height, which is the approximate height of a human face and therefore an effective sized target area for hand and foot strikes. When viewed from the top the pad will appear to be a nearly half circle as shown in FIG. 1.2. The back of the striking pad surface may be supported by a sheet of pressboard 22 or similar material, which may contain four threaded inserts 23 (FIG. 5.0). The four threaded inserts 23 are placed to line up with receiving holes 49 on a pad mounting plate 12. Given the size of the striking pad 20 shown in FIG. 5.0, four connection points between the pad and mounting plate 12 (FIG. 4.1, 4.3, 4.5) were found to be adequate, however a striking pad of alternative sizing may require more of fewer connection points.

The pad mounting plate 12 provides a firm mounting surface for the striking pad 20. Its primary purpose is to allow for movement of the striking pad 20 along a mounting rod 13, (with the help of the bushing assembly as shown in FIG. 9.1) when struck by a user, particularly with a comparatively low level of force.

Referring to FIG. 4.1, the pad mounting plate 12 is comprised of, for example, a ¼"×8"×12" plate formed from hot rolled steel (HRS) which is configured with four receiving holes 49 which line up with the threaded inserts 23 on striking pad 20. The pad mounting plate 12 shown has four mounting rods 13 welded to it. In the embodiment shown, the pad mounting plate 12 is firmly secured to the back of striking pad 20 by securing it through the pad mounting plate receiving holes 49 into the threaded inserts 23 using 4 bolts 50, optionally with lock washers and flat washers.

Referring to FIG. 4.1, the pad mounting plate 12 is connected to a pad connector plate 14. The pad connector plate may serve three or more purposes: First it may provide a firm surface for the pad mounting plate 12 to move against when struck by a user; second it may provide a means of fastening the entire striking pad assembly (FIG. 4.1) to a connector channel assembly, shown in FIG. 6.0, that can be easily and quickly mounted and removed by the user; third, it may provide a mounting surface for the bushing assemblies shown in FIG. 9.1. In one embodiment, the pad connector plate 14 consists of a ⅜"×8"×12" plate formed from cold roll steel (CRS). The pad connector plate 14 in this embodiment has twelve holes drilled in it, three in each corner. In one embodiment, these may be UHMW (ultra high molecular weight polyethylene) mounting holes 66. The center hole lines up with the position of the mounting rods 13 that are welded to the pad mounting plate 12. On either side of this center hole are two smaller holes, all three of the UHMW mounting holes 66 are designed to line up with the UHMW holes 61 which are drilled into a UHMW bushing block 46 (FIG. 9.1). The current embodiment uses the UHMW bushing block 46 which is comprised of UHMW material, sized to fit and drilled with the UHMW holes 61 described above.

In order to create the necessary movement of the striking pad, the pad mounting plate 12 and pad connector plate 14 are assembled with the bushing assembly as described herein. Referring to FIGS. 9.0 and 9.1, compression spring one 48 is placed over the mounting rod 13. The pad connector plate 14 is then slid into place by inserting the four center UHMW mounting holes 66 over the mounting rods 13 (FIG. 4.1 shows this more clearly). The UHMW bushing block 46 is then put into place by placing the center UHMW hole 61 over the mounting rod 13 and is secured with the UHMW bushing screws 62 which are placed through both the smaller UHMW holes 61 on the UHMW bushing block 46, and then through UHMW mounting holes 66 on the pad connector plate 14. A washer 63 is inserted on the two outer screws 62 on either side of the pad connector plate 14. A washer 63 is inserted on the two outer screws 62 on either side of the pad connector plate option one 14, and is then secured with UHMW nuts 64.

The size, length and resistance characteristics of compression spring one 48 can be varied to achieve the desired effect and resistance. In one embodiment, shown in FIG. 9.1, several flat washers, 47 are placed on the mounting rods 13 on the opposite side of the UHMW bushing block 46 from the compression spring one 48 to be used as spacers. It should be understood that any hardware that can act as an effective spacer would suffice in this situation. However in this embodiment a number of washers are used because they allow for simple adjustments based on the length of the compression spring one 48 being used. To complete the bushing assembly attachment to the pad connector plate 14, a mounting rod nut 65 is threaded on the mounting rod 13 and is loosely secured to the flat washers 47. As one of ordinary skill in the art will understand, the number, position, materials and configuration of the mounting rods 13 and bushing assemblies can be varied to achieve the desired effect.

One of the features of the device is the ability to quickly and easily remove the striking pads if desired. Therefore, a mounting mechanism must be built in to the device to allow for this. Referring again to FIG. 4.1, one embodiment of the pad connector plate 14 is configured with two tabs 51, 52 which are welded to the back of the plate. Top tab 51 is shown with a tab receiving hole 58 through which it will receive a pull pin 19 (see FIG. 6) when top tab 51 is placed into top tab guide slot 54. The bottom tab 52 is shown with a bottom tab notch 59 cut in it which will ultimately line up with a bottom retainer pin 29 (FIG. 6.1) when bottom tab 52 is placed into bottom tab guide slot 56. The striking pad assembly 2 (FIG. 4.0) can then easily be mounted and removed from the device by placing top tab 51 and bottom tab 52 (FIG. 4.1) into top tab guide slot 54 and bottom tab guide slot 56 (FIG. 6) and then allowing bottom tab notch 59 to rest on the bottom retainer pin 29 and securing with pull pin 19 which is placed through pull pin receiving holes 57 and 78.

In order to provide an effective user experience in regards to the knee and elbow strikes, the device must provide movement in a plurality of directions. In addition, the compression spring one 48 and the bushing assembly 15 are not durable enough to withstand the pressures of heavy blows from experienced fighters particularly with knees and elbows. This issue is solved in one embodiment with the addition of a connector channel assembly (FIGS. 6.0, 6.1 and 6.2). Referring to FIG. 6, the connector channel assembly shown consists of a connector channel post 53. The connector channel post 53 has a bottom retainer pin 29 (FIG. 6.1) welded inside it at a point that will allow access through the bottom tab guide slot 56 for bottom tab notch 59 to rest on when mounted (as explained above).

The front of the channel connector assembly has four slots 54, 55, 56 and 60. Slot 54 is positioned to align with the top tab 51 of the pad mounting plate and slot 56 placed to line up with the bottom tab 52 built into the pad connector plate 14. The top tab guide slot 54 in this embodiment is approximately 3 inches in length. The bottom tab guide slot 56 is also approximately 3 inches in length. The connector channel post 53 will have a right pull pin receiving hole 57 and a left pull pin receiving hole 78 drilled into it.

When the striking pad assembly 2 (in FIG. 4) is mounted to the connector channel post 53 (FIG. 6), the hole 58 in the top tab 51 (FIG. 4.1) will align with the right pull pin receiving hole 57 and left pull pin receiving hole 78 (FIG. 6) to allow the user to place the pull pin 19 through both the holes 57 and 78 and the top tab receiving hole 58, to firmly secure the striking pad assembly. The connector channel post 53 also has a bottom retainer pin 29 (FIG. 6.1) welded into it so that it can be accessed through the bottom tab guide slot 56. The bottom retainer pin 29 is configured to line up with the bottom tab notch 59 (FIG. 4.1) of the pad mounting plate, when the striking pad assembly 2 is in the mounted position.

When a user wishes to mount a striking pad assembly to the connector channel post 53 (FIG. 6), they will place the top tab 51 and the bottom tab 52 of the pad connector plate into the top tab guide slot 54 and the bottom tab guide slot 56 near the top of the two slots. The striking pad assembly can then be easily lowered so that notch 59 on the pad connector plate bottom tab 52 rests securely on the bottom retainer pin 29 to hold the bottom portion of the striking pad. The pull pin receiving hole 57 on the connector channel post 53 will line up with the hole 58 in the top tab 51 and a pull pin 19 can then be placed through guide hole 57 and through the hole 58 in the top tab 51 to securely hold the striking pad assembly 2 in place.

The channel connector assembly must now be attached to a main post in a manner that provides for the movement and durability described above. In one embodiment, the channel connector assembly may be attached to the main post by using, for example, a spring assembly such as the one shown in FIG. 7. The assembly is shown attached to a main post 1 (FIG. 7) with the use of two mounting rods 32, which are attached through the main post 1 and have a quantity of threading on one end which will be used to secure the channel connector assembly to the main post 1 with a channel to main post nut 67. The mounting rods 32 have a compression spring 33 on each of them which will provide additional movement and resistance to punches, kicks, and elbow strikes.

The front of the channel connector assembly may have two access holes 55 and 60 drilled into it. These holes may line up with bushings 28 (FIG. 6.0) that are inserted into the back of the connector channel post 53 (FIG. 6.2). When assembled, the channel connector assembly (FIG. 6), will be placed onto the main post 1 (FIG. 7) by allowing mounting rods 32 to be inserted into the bushing 28.

Referring to FIG. 6.2, in one embodiment of the channel connector assembly, the connector channel post 53 may comprise an audible feedback device. In one embodiment, the back of the connector channel may have six additional holes drilled in it. Four of these holes will be used to attach a carriage bolt assembly 27. Each carriage bolt assembly 27 should be placed close to the top and bottom of the back of the connector channel post 53, as indicated in the drawings in FIG. 6.2.

Once secured, upon application of an appropriate force on the striking pad, the heads of the carriage bolts will strike the main post 1 to produce an audible effect. This audible effect may provide positive feedback to a user, informing user that proper force was delivered.

The other two of the six holes may be used for two bushings 28 (FIG. 6.0, 6.2). The bushings 28 may be placed equidistant from the top and bottom of the connector channel post 53 to optimize effectiveness. Each bushing 28 will have two small holes on its outer circumference that receive two stainless steel rivets to fasten to the back of the connector channel post 53. The bushing must be durable enough to withstand the intended forces.

The main post assembly (FIG. 7) is the central structure of the present invention, in that all of the features of the device are built either in front of or behind the main post. The main post is durable and secure with the ability to mount one of a plurality of striking pads and their preferably associated hardware.

In one embodiment the main post assembly 1 is 2½ inch square by 3/16 inch wall by 67½ inch HRS. Eight 5" mounting rods 32 with threaded ends may be welded through the main post 1 in positions that line up with the position of the two bushings 28 that are located on each of the four connector channel posts 53. The threaded end of the mounting rods 32 will extend outward. The mounting rods 32 are welded in a position which extends through the main post 1 in a manner that is secure enough to withstand forces applied from punching, kicking and the like.

The connector channel assembly 53 (FIG. 6) is attached to the main post assembly 1 (FIGS. 1.0, 1.1, and 7.0) first by placing compression spring 33 over the portion of the mounting rod 32 that extends from a side 31 of the main post assembly 1 (FIG. 7.0.1). The channel connector assembly (FIG. 6) is then placed onto the mounting rods 32 with the mounting rods 32 passing through the bushing 28. The channel is then secured by tightening a main post nut 67 to the threaded end of the mounting rod 32 which may be done with a ratchet wrench accessing the nut through the access holes 55 and 60 (FIG. 6).

In one embodiment, the wall mount assembly may provide a number of functions for the device: First, it is the most aggressive noise and vibration dampening mechanism on the device. When a device such as this is mounted to a wall without proper noise and vibration reduction technology, the device may be disturbing to others in a building or home and also potentially destructive or damaging to the wall itself; second it is the structure that attaches the main post 1 to a wall 101. This is the feature that eliminates the need for a partner to hold equipment. The third purpose of the wall mount assembly is to allow for spring loaded movement (in conjunction with the caster assembly described below) when the striking pad is struck with significant force. This movement provides a more realistic experience for the user because it simulates the lifelike movements of an opponent.

In one embodiment, the wall mount assembly may include a spring assembly as shown in FIGS. 8 and 8.1. The wall mount assembly (FIGS. 8 and 8.1) is attached to the main post assembly 1 by securing a front wall mount plate 44 to the main post 1 with the main post mounting bolt assembly 45. Bolts 45 are passed through the main post assembly 1 and threaded into two main post mounting threaded receiving holes 100.

The wall mount assembly is attached to the wall 101 via a rear wall mount plate 38 which in one embodiment is 1"×2 ½"×20" plate of C.R.S, however it should be understood that an alternative size may be used. The rear wall mount plate 38 is anchored securely to a wall 101, in whatever fashion necessary for it to withstand the punching and kicking forces applied.

Two mounting rods 39 are welded to, and extend from, the rear wall mount plate 38 (FIG. 8.1)

In order to minimize the noise and vibration generated from the use of the device, and to assist in providing the desired movement, one embodiment has the following parts placed over the mounting rods 39 in the order described here, starting from the wall and working outward. It should be understood that any rearrangement, modification, change or substation that achieves a similar significant noise and vibration reduction would be acceptable, including the introduction of commercially available technologies from a third party remains within the scope of the present invention.

In one embodiment, each of the mounting rods 39 first receives a compression spring **42*a*, next a rubber cushion 43*a*, is placed on the rod and the spring fits inside of this rubber cushion 43*a* and extends beyond the end of the rubber cushion 43*a*. Next a washer 69 rests against compression spring 42*a*, next a first bushing 70*a* is inserted into the washer 69 and inside of the compression spring 42*a*, next a bushing 70*a* is inserted into the washer 69 and inside of the compression spring 42*a*. A second bushing 70*b* is placed to abut the first bushing 70*a* so the large ends of both bushings are in contact with one another. A second compression spring 42*b* is placed on the second bushing 70*b*, a third bushing is placed at the end of the second compression spring. Next the mounting rods 39 are placed through the front wall mount plate 44, a metal washer 71 and three felt washers 72 are placed on the rod (with the metal washer 71 being placed against the front wall mount plate 44), the mounting rods 39 are then fit into a second rubber cushion 43*b* with the assistance of a rubber bushing/grommet 73 for sizing. The assembly is held together by a knob 49 which inserts into the second rubber cushion 43*b* and is fastened to the threads on the mounting rods 39**.

Because the device is designed to provide a certain amount of movement when struck, the main post 1 must be able to move, and cannot be secured permanently to a static floor or base structure. Therefore, the main post 1 must be mounted on a movement device such as a ball, wheel, caster 37, sliding track or other similar movement device. This device provides support for the device as well as allowing for horizontal movement. In one embodiment, the main post 1 is mounted on a caster 37 and secured using mounting rod 36 to provide the necessary movement. (FIGS. 7.0, 7.0.2, 7.1).

In another embodiment of the device, the striking pad assembly 9 (FIG. 4.2) is attached directly to the main post (FIG. 2.1, FIG. 7.1). This may simplify the device from a manufacturing point of view, reduce the cost of the device, and in some operative conditions may achieve superior performance.

This embodiment will therefore now have three components. The striking pad assembly 9 which is directly attached to main post 7/34 which is attached to a wall mount assembly 4. The wall mount assembly 4 is constructed and arranged to be mounted securely to a wall 101.

Referring to FIGS. 2.0, 2.1, 4.2 and 4.3, the striking pad assembly 9 is almost identical to the striking pad 2 (FIGS. 1.0, 1.1, 4.0 and 4.1) used in the previous embodiment. The only component that changed is the pad connector plate 14 shown in FIG. 4.1 is replaced with pad connector plate 16 shown in FIG. 4.3. In this embodiment of the pad connector plate 16, the pad mounting plate top tab 51 and the pad mounting plate bottom tab 52 are not present and are replaced with two pad connector plate mounting holes 76. These holes are designed to line up with mounting rod 35 which is placed through the main post assembly 7/34.

Referring to FIG. 2.1 and FIG. 7.1, the main post assembly 7/34 is similar to the main post assembly 1 shown in FIGS. 1.0, 1.1 and 7.0 referred to above. The difference is in the method of mounting of the striking pad to the main post assembly 7/34. In this second embodiment, the striking pad assembly 9 is attached by placing a mounting rod 35 (FIGS. 7.1 and 7.1.1) through holes 68 of the main post assembly 7/34 and securing the mounting rod to a mounting hole 76 of the pad connector plate 16. Mounting rod 35 is also shown as mounting rod 8 in FIG. 2.1.

The bushing assembly (FIGS. 9 and 9.1) may be identical to that described in the previous embodiment. Further, the main post assembly 7/34 may be attached to the wall mount assembly shown in FIG. 8.0 the same manner as described above.

Referring now to FIG. 4.5, another embodiment is provided. Striking pad 17 is a modified Focusmaster™ torso pad (see admitted prior art). Focusmaster™ notes that the torso pad is not suitable to be used for kicking, therefore the covering of the pad must be removed and replaced with a more durable material such as vinyl or canvas 21. One embodiment may use a 14 oz per sq. yard PVC vinyl coated polyester; however, any suitable material will be sufficient.

In another embodiment, the Focusmaster™ product may have a mounting plate provided with the product removed from the back of the pad. Pad mounting plate 12 is then attached to the striking pad 17 in the same manner as described in the previous embodiments using the threaded inserts that are already present in the Focusmaster™ torso pad.

A pad connector plate 18 must be fashioned to complete the assembly. In this embodiment, the plate may consist of ⅜"× 8"×12" CRS similar to the pad connector plate 16. Pad connector plate 18 will also have the same series of holes drilled into it as the previous pad connector plate embodiments.

In a further embodiment, the Focusmaster™ mounting connector is removed from the Focusmaster™ back plate and attached to pad connector plate 18. Testing has found that the Focusmaster™ back plate is inadequate to withstand the heavy hitting and kicking that the current embodiment is designed to handle. The Focusmaster™ product became fatigued and broke during our testing. It is therefore critical that a heavier duty connector plate, as described above, or its equivalent, be used.

The bushing assembly (FIG. 9) may be identical to that described for the previous embodiments and is fitted on this embodiment in the same way, which may hold the entire assembly together.

A speed bag attachment shown in FIG. 10.0 can be easily and quickly attached to and removed from any of the striking pads on the device. The purpose of the attachment is to greatly increase number of strikes and kicks that can be practiced with the device. The speed bag attachment provides an additional way for an athlete to practice upper cut strikes and side to side strikes. Further, it provides an excellent target for front kicks and round house style kicks. The ability to move it to any striking pad means it can be adjusted to various heights depending on the ability and goals of the athlete.

Referring to FIG. 10.1, a standard, commercially available speed bag 80, with its loop 99 which has a bungee cord 81 running through it is presented. The bungee cord will then pass through a large rubber grommet 82. The grommet is then fitted into a reducer 84 which fits into a mounting flange 86. The bungee cord is then passed through the 4 inch mounting flange 86 and is tied off with washers 90 at the point where the mounting holes 87 meet the wooden base 88. All of the above components are encased in a padded foam enclosure 85 that provides protection for them from the athlete and protection for the athlete from being injured. The covering used in the current embodiment may be the same covering used for the striking pad outer covering 21. Before the covering is applied, nylon strapping 89 is secured to wooden base 88 with wood screws 92 and washers 93. To secure the speed bag attachment to the striking pad, wrap nylon strapping 89 around any of the striking pad assemblies and secure with a D-ring 91.

What is claimed is:

1. A striking apparatus comprising:

a substantially vertically configured main post;

a plurality of striking pads, each of the plurality of striking pads connected to the main post by a first spring assembly;

a wall mount assembly connected to the main post by a second spring assembly, the first spring assembly and the second spring assembly being oriented substantially perpendicular to the main post, the wall mount assembly constructed and arranged to be mounted to a wall; allowing the substantially vertically configured main post to be approximately parallel with the wall; and a movement device attached to a bottom of the main post, the movement device sized and positioned such that it contacts a floor, the floor being substantially perpendicular to the wall, the movement device supporting the apparatus and allowing movement of the main post in a substantially horizontal plane that is approximately perpendicular to the substantially vertically configured main post.

2. The striking apparatus of claim 1 wherein the plurality of striking pads are connected to the main post equidistantly from each other and in substantially the same vertical plane as the main post.

3. The striking apparatus of claim 2 wherein the main post has a first height, and wherein the plurality of striking pads are connected to the main post such that a plurality of users of all sizes may strike the apparatus without its adjustment.

4. The striking apparatus of claim 3 wherein the plurality of striking pads are positioned to allow one of the plurality of users to simulate a plurality of different strikes comprising leg kicks, mid section kicks, body punches, uppercut punches, and head punches without modification of the position of any of the plurality of strike pads.

5. The striking apparatus of claim 4 wherein the plurality of striking pads are configured and arranged such that the plurality of users of all sizes and skill may simulate the plurality of strikes.

6. The striking apparatus of claim 1 wherein the main post further comprises a plurality of connector channel assemblies, one of the plurality of connector channel assemblies positioned between each of the plurality of striking pads and the main post, wherein a third spring assembly attaches the connector channel assembly to the main post, and wherein the first spring assembly attaches one of the plurality of striking pads to one of the plurality of connector channel assemblies.

7. The striking apparatus of claim 6 further comprising an audible feedback device constructed and arranged to provide audible feedback to a user upon application of a sufficient amount of force to the striking pad by the user.

8. The striking apparatus of claim 7 wherein the main post is constructed of a metal, and wherein the audible feedback device is a protrusion from one of the plurality of connector channel assemblies, and wherein, upon application of the sufficient amount of force, the metal protrusion may strike the main post in a manner that provides audible feedback.

9. The striking apparatus of claim 1 wherein the pads are constructed and connected to the main post to receive a plurality of different strikes from a plurality of different angles.

10. The striking apparatus of claim 9 wherein the plurality of different strikes comprise strikes from above, below, straight on, and from a side of one of the plurality of striking pads.

11. The striking apparatus of claim 1 further comprising a speed-bag attachment attached to one of the plurality of striking pads.

12. The striking apparatus of claim 11 wherein the speed-bag attachment is removably attached to the one of the plurality of striking pads.

13. The striking apparatus of claim 1 wherein the movement device is a caster assembly.

14. The striking apparatus of claim 1 wherein the movement device is a roller mounted within a track of the floor.

15. The striking apparatus of claim 1 wherein each of the plurality of striking pads is removably connected to the main post.

16. The striking apparatus of claim 1 wherein a spring of the first spring assembly has a resistance less than a spring of the second spring assembly.

17. The striking apparatus of claim 1 wherein the apparatus is mounted to a stud of a framing of a household wall without reinforcement of the stud to which the apparatus is attached.

18. A striking apparatus comprising:

a substantially vertically configured main post;

a connector channel assembly, the connector channel assembly connected to the main post by a first spring assembly;

a plurality of striking pads, each of the plurality of striking pads removably connected to the connector channel assembly by a second spring assembly; each of the plurality of striking pads connected equidistantly along the height of the main post;

a wall mount assembly connected to the main post by a third spring assembly, the first spring assembly, the second spring assembly, and the third spring assembly being oriented substantially perpendicular to the main post, the wall mount assembly mounted to a wall; and a movement device attached to a bottom of the main post, and partially supporting a weight of the apparatus by contacting a floor, the floor being substantially perpendicular to the wall, the movement device allowing movement of the main post in a substantially horizontal plane.

19. A striking apparatus comprising:

a substantially vertically configured main post;

a plurality of striking pads, each of the plurality of striking pads connected to the main post by a first spring assembly;

a wall mount assembly connected to the main post by a second spring assembly, the wall mount assembly mounted to a wall allowing the substantially vertically configured main post to be approximately parallel with the wall; and a movement device attached to a bottom of the main post and partially supporting a weight of the apparatus by contacting a floor, the floor being substantially perpendicular to the wall, the movement device allowing movement of the main post in a substantially horizontal plane towards and away from the wall, the substantially horizontal plane being approximately perpendicular to the substantially vertically configured main post.

20. The striking apparatus of claim 19, wherein the movement of the movement device is in response to a sufficient amount of force applied to the striking pad by a user.

* * * * *